US006831419B1

(12) United States Patent
Schmitkons et al.

(10) Patent No.: US 6,831,419 B1
(45) Date of Patent: Dec. 14, 2004

(54) EXHAUST SYSTEM FOR A MICROWAVE EXCITED ULTRAVIOLET LAMP

(75) Inventors: James W. Schmitkons, Lorain, OH (US); James M. Borsuk, Westlake, OH (US); Jan L. Shanaberger, Westlake, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/452,436

(22) Filed: Jun. 2, 2003

(51) Int. Cl.[7] ..... H01J 7/24; G21G 5/00

(52) U.S. Cl. ..... 315/112; 250/492.2; 362/294; 362/311

(58) Field of Search ..... 315/112; 250/492.1, 250/492.2, 492.3, 493.1, 504 R, 503.1; 362/263, 264, 294, 311

(56) References Cited

U.S. PATENT DOCUMENTS

| | | | | |
|---|---|---|---|---|
| 3,826,014 A | * | 7/1974 | Helding | 34/277 |
| 3,872,349 A | * | 3/1975 | Spero et al. | 315/39 |
| 4,042,850 A | | 8/1977 | Ury et al. | 315/39 |
| 4,504,768 A | | 3/1985 | Ury et al. | 315/248 |
| 4,695,757 A | | 9/1987 | Ury et al. | 313/44 |
| 4,965,876 A | | 10/1990 | Foldi et al. | 362/247 |
| 4,990,789 A | | 2/1991 | Uesaki | 250/504 R |
| 5,440,137 A | * | 8/1995 | Sowers | 250/504 R |
| 5,504,391 A | | 4/1996 | Turner et al. | 313/570 |
| 6,507,031 B1 | * | 1/2003 | Jinbo et al. | 250/455.11 |

OTHER PUBLICATIONS

Fusion UV Systems, Inc., *Modular Light Shield Systems*, Tech Notes, 2001 (4 pages).

* cited by examiner

*Primary Examiner*—Thuy Vinh Tran
(74) *Attorney, Agent, or Firm*—Wood, Herron & Evans, LLP

(57) ABSTRACT

An exhaust system for use with a microwave excited ultraviolet lamp system is provided to receive cooling air emitted from the lamp system and to contain and direct the cooling air so as not to contact a substrate being irradiated with ultraviolet light. A lens, such as a quartz lens, is supported by the exhaust duct to transmit the ultraviolet light emitted from the lamp system toward the substrate.

15 Claims, 4 Drawing Sheets

EXHAUST SYSTEM FOR A MICROWAVE EXCITED ULTRAVIOLET LAMP

FIELD OF THE INVENTION

The present invention relates generally to microwave excited ultraviolet lamp systems and, more particularly, to an exhaust system for directing cooling air used in such lamp systems.

BACKGROUND OF THE INVENTION

Ultraviolet lamp systems, such as those used in the heating or curing of adhesives, sealants, inks or other coatings for example, are designed for coupling microwave energy to an electrodeless lamp, such as an ultraviolet (UV) plasma lamp bulb mounted within a microwave chamber of the lamp system. In ultraviolet lamp heating and curing applications, one or more magnetrons are typically provided in the lamp system to couple microwave radiation to the plasma lamp bulb within the microwave chamber. The magnetrons are coupled to the microwave chamber through waveguides that include output ports connected to an upper end of the chamber. When the plasma lamp bulb is sufficiently excited by the microwave energy, it emits ultraviolet radiation through an open lamp face of the lamp system to irradiate a substrate which is located generally near the open lamp face.

A source of pressurized air is fluidly connected to a housing of the lamp system which contains the magnetrons, the microwave chamber and the plasma lamp bulb. The source of pressurized air is operable to direct cooling air, such as 350 CFM of cooling air for example, through the housing and into the microwave chamber to properly cool the magnetrons and the plasma lamp bulb during irradiation of the substrate by the lamp system.

In some UV heating and curing applications, the lamp system includes a mesh screen mounted at the open lamp face which is transmissive to ultraviolet radiation but is opaque to microwaves. The configuration of the mesh screen also permits the significant air flow of cooling air to pass therethrough and toward the substrate.

In some applications, however, the substrate may require a clean environment, such as in a curing chamber, so that the substrate will not be contaminated during the heating and curing process by contaminants carried by the cooling air in contact with the substrate. The substrate may also be somewhat delicate and therefore susceptible to damage in harsh environments, such as under the influence of the significant air flow of the cooling air which impinges upon and possibly disturbs the substrate. Oftentimes, the substrate may also be adversely affected by excessive heat which may be generated by the plasma lamp bulb during the irradiation process.

Accordingly, there is a need for a microwave excited ultraviolet lamp system which may be used in a clean environment to prevent contamination of a substrate by the cooling air necessary to properly cool the lamp system. There is also a need for a lamp system which reduces or eliminates the potential damage to a substrate by the significant air flow of cooling air used to cool the lamp system. There is yet also a need for a lamp system which minimizes heat transfer from the plasma lamp bulb to the substrate being irradiated.

SUMMARY OF THE INVENTION

The present invention overcomes the foregoing and other shortcomings and drawbacks of heretofore known exhaust systems for microwave excited ultraviolet lamp systems. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, a microwave excited ultraviolet lamp system or light source is provided having an exhaust system mounted thereto in accordance with the principles of the present invention. The light source includes a housing which is connected to a source of pressurized air which is operable to direct cooling air through the housing and into the microwave chamber to cool the magnetrons and plasma lamp bulb of the light source.

The exhaust system of the present invention is mounted in fluid communication with the light source and is configured to contain and direct the cooling air emitted by the lamp source so as not to contact the substrate being irradiated with ultraviolet light. The exhaust system comprises an enclosed exhaust duct having an air inlet port configured to receive the cooling air emitted from the light source and an air exhaust port configured to direct the cooling air within the exhaust duct to a location remote from the light source so that the cooling air does not contact and thereby possibly contaminate or disturb the substrate.

A lens, such as a quartz lens, is supported by the exhaust duct and is operable to transmit the ultraviolet light emitted from the light source toward the substrate. The quartz lens is beneficial to reduce heat transfer to the substrate from the plasma lamp bulb and also serves as an air shield to prevent the cooling air from contacting the substrate.

In accordance with another aspect of the present invention, a sensor, such as a differential pressure transducer, is provided within the housing of the light source to insure that a sufficient cooling air flow rate is being provided for proper operation of the magnetrons and the plasma lamp bulb. The pressure transducer senses the pressure drop between the interior of the housing and the exhaust system and provides a signal to a control of the light source to shutdown operation when the desired pressure drop is not sensed by the pressure transducer.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 2:
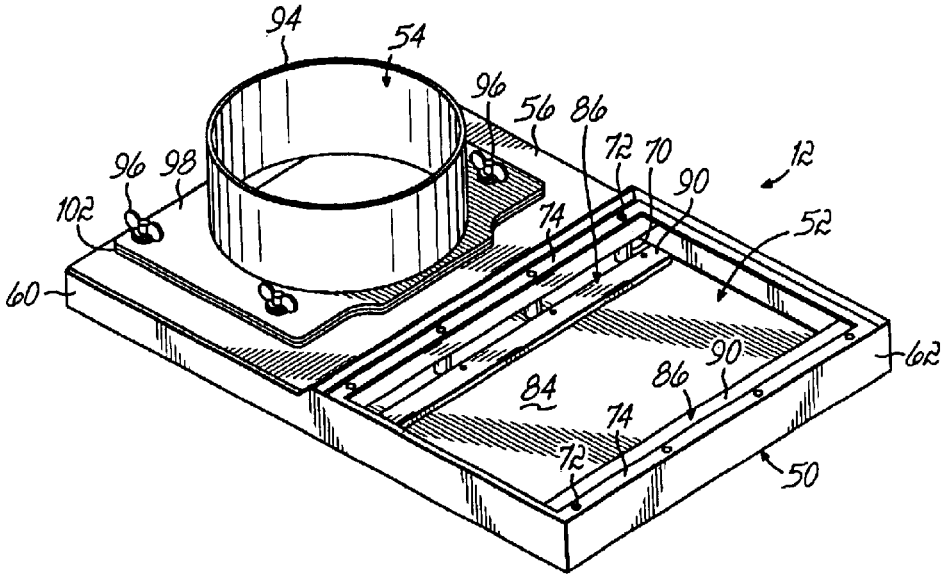
FIG. 2 is a perspective view of the exhaust system shown in FIG. 1.
Figure 3:
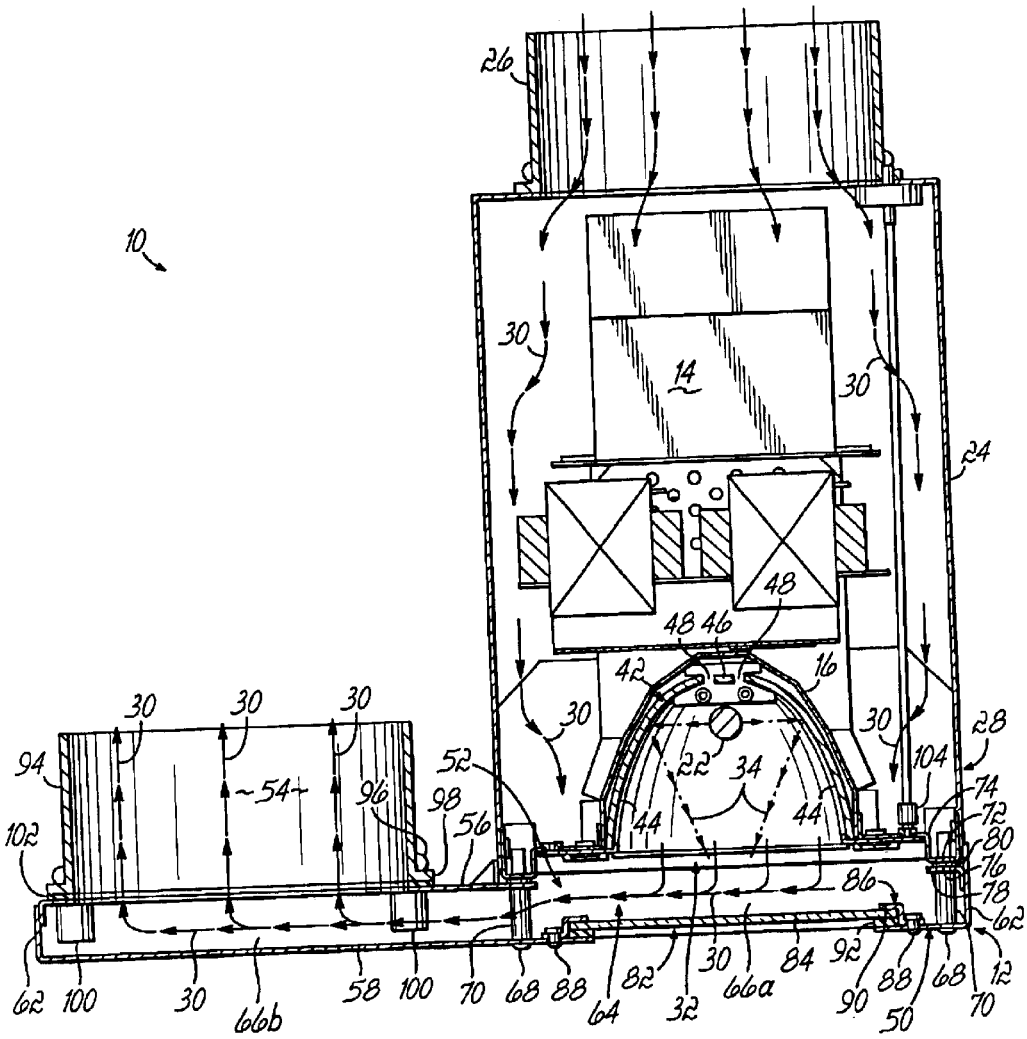
FIG. 3 is a cross-sectional view of the lamp system and exhaust system taken along line 3—3 of FIG. 1.
Figure 4:
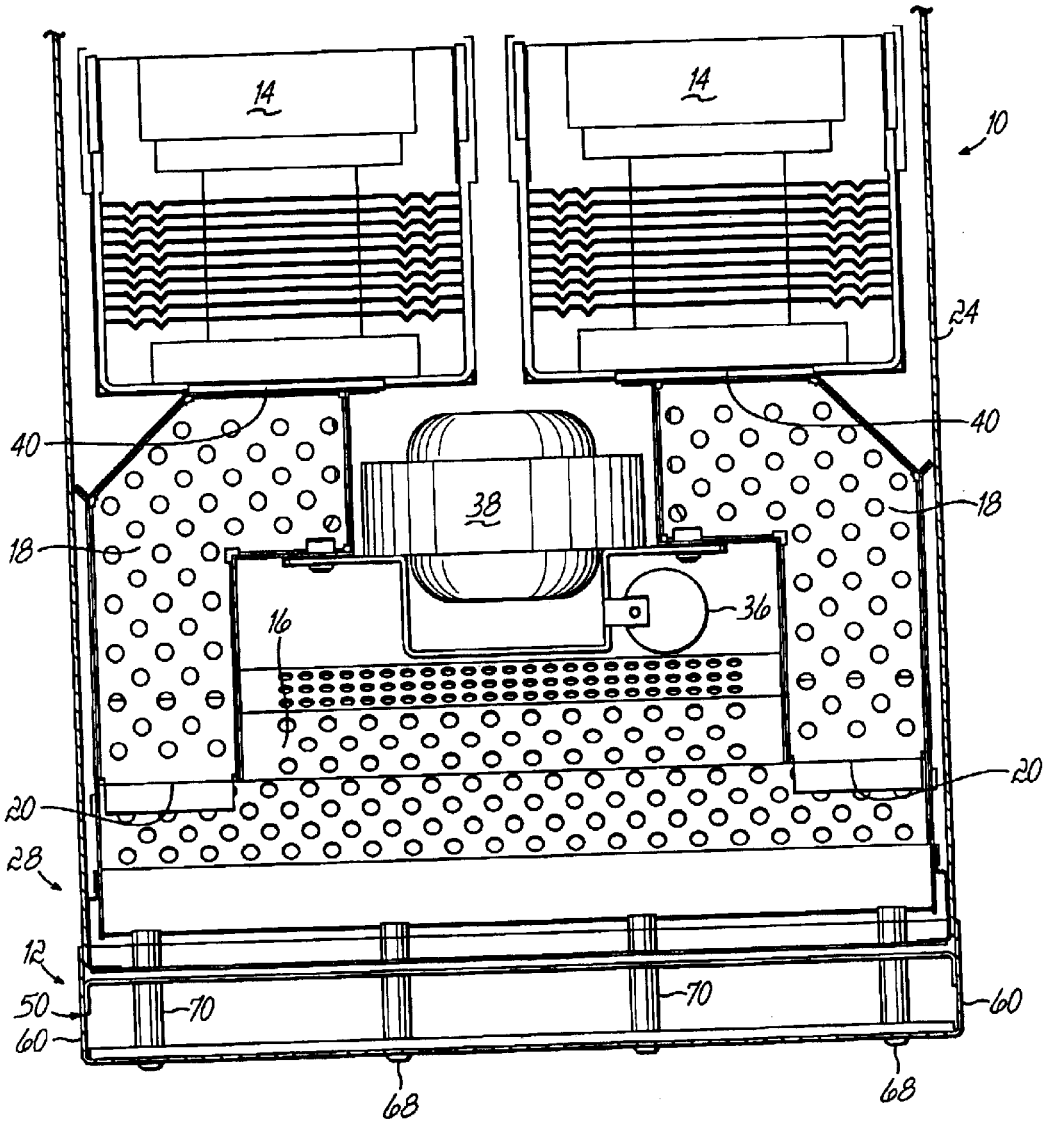
FIG. 4 is a cross-sectional view of the lamp system and exhaust system taken along line 4—4 of FIG. 1.

With reference to the FIGS. 1–4, a microwave excited ultraviolet ("UV") lamp system or light source 10 is shown including an exhaust system 12 mounted thereto in accordance with the principles of the present invention. Light source 10 includes a pair of microwave generators, illustrated as a pair of magnetrons 14 (FIG. 4), that are each coupled to a longitudinally extending microwave chamber 16 through a respective waveguide 18 (FIG. 4).

Each waveguide 18 has an outlet port 20 (FIG. 4) coupled to an upper end of the microwave chamber 16 so that microwaves generated by the pair of microwave generators 14 are coupled to the microwave chamber 16 in spaced longitudinal relationship adjacent opposite upper ends of the chamber 16. An electrodeless plasma lamp 22, in the form of a sealed, longitudinally extending plasma bulb, is mounted within the microwave chamber 16 and supported adjacent the upper end of the chamber 16 as is well known in the art.

Figure 5:
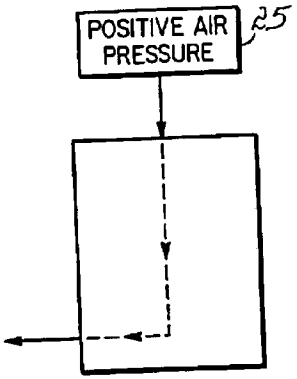
FIGS. 5–8 are diagrammatic views of alternative embodiments of the present invention.

Light source 10 includes a housing 24 which is connected in fluid communication with a source of pressurized air 25 (FIG. 5) in one embodiment through an air inlet duct 26 as is well known in the art. The air inlet duct 26 is located at an upper end of the housing 24 and the lower end of the housing 24 forms a lamp head 28 (FIG. 3). The source of pressurized air 25 is operable to direct cooling air, represented diagrammatically by arrows 30 in FIG. 3, through the housing 24 and into the microwave chamber 16 to cool the magnetrons 14 and plasma lamp bulb 22 as will be described in greater detail below. The cooling air 30 passes through the microwave chamber 16 and is emitted through an open lamp face 32 (FIG. 3) of the lamp head 28.

Light source 10 is designed and constructed to emit ultraviolet light, illustrated diagrammatically by arrows 34 in FIG. 3, through the open lamp face 32 (FIG. 3) of the light source 10 upon sufficient excitation of the plasma lamp bulb 22 by microwave energy coupled to the microwave chamber 16 from the pair of microwave generators 14. While a pair of magnetrons 14 are illustrated and described herein, it is to be understood that the light source 10 may include only a single magnetron 14 to excite the plasma lamp bulb 22 without departing from the spirit and scope of the present invention.

As shown in FIG. 4, light source 10 includes a starter bulb 36 and a pair of transformers 38 (one shown) that are each electrically coupled to a respective one of the magnetrons 14 to energize filaments of the magnetrons 14 as understood by those skilled in the art. The magnetrons 14 are mounted to inlet ports 40 (FIG. 4) of the waveguides 18 so that microwaves generated by the magnetrons 14 are discharged into the chamber 16 through the longitudinally spaced apart outlet ports 20 of the waveguides 18. Preferably, the frequencies of the two magnetrons 14 are split or offset by a small amount to prevent intercoupling between them during operation of the light source 10.

A longitudinally extending reflector 42 is mounted within the microwave chamber 16 for reflecting the ultraviolet light 34 emitted from the plasma lamp bulb 22 toward a substrate (not shown) which is located generally near the open lamp face 32 of the lamp head 28. In one embodiment, reflector 42 has an elliptical configuration in transverse cross-section, although parabolic or other cross-sectional configurations are possible without departing from the spirit and scope of the present invention.

As shown in FIG. 3, reflector 42 includes a pair of longitudinally extending reflector panels 44 that are mounted in opposing, i.e., mirror facing relationship within the microwave chamber 16 and in spaced relationship to the plasma lamp bulb 22. Each reflector panel 44 is preferably made of coated glass, although other materials having suitable reflective and thermal properties are possible as well. When made of coated glass, for example, each reflector panel 44 is transparent to the microwave energy generated by the pair of magnetrons 14 but opaque to and reflective of the ultraviolet light 34 emitted by the plasma lamp bulb 22.

Further referring to FIG. 3, a longitudinally extending intermediate member 46 is mounted within the microwave chamber 16 in spaced relationship to the reflector panels 44, and also in spaced relationship to the plasma lamp bulb 22. The intermediate member 46 may be made of glass, such as PYREX®, and may uncoated to be non-reflective of the ultraviolet light 34 emitted by the plasma lamp bulb 22.

When the pair of reflector panels 44 and the intermediate member 46 are mounted within the microwave chamber 16 to form the reflector 42, a pair of spaced, longitudinally extending slots 48 (FIG. 3) are formed between the reflector panels 44 and the intermediate member 46. The pair of spaced, longitudinally extending slots 48 are operable to pass cooling air 30 from the pressurized air source 25 (FIG. 5) toward the plasma lamp bulb 22 so that the cooling air 30 envelops the plasma lamp bulb 22 effectively entirely about its outer surface to cool the bulb 22. Details of the construction of the reflector 42 is fully described in commonly owned and co-pending U.S. Ser. No. 10/182,164, entitled "Microwave Excited Ultraviolet Lamp System With Improved Cooling", the disclosure of which is hereby incorporated herein by reference in its entirety. Of course, other reflector configurations are possible as well as will be readily understood by those of ordinary skill in the art. The cooling air 30 thereafter passes through the microwave chamber 16 and is emitted through the open lamp face 32 of the lamp head 28.

In accordance with the principles of the present invention as shown in FIGS. 1–4, the exhaust system 12 is mounted in fluid communication with the lamp head 28 so that the cooling air 30 emitted from the open lamp face 32 is contained and directed within the exhaust system 12 so as not to contact the substrate (not shown) being irradiated. The exhaust system 12 comprises an enclosed exhaust duct 50 having an air inlet port 52 (FIG. 3) configured to receive the cooling air 30 emitted through the open lamp face 32 and an air exhaust port 54 (FIG. 3) configured to direct the cooling air 30 within the exhaust duct 12 to a location remote from the lamp head 28 so that the cooling air 30 does not contact the substrate (not shown).

In one embodiment, the exhaust duct 50 includes a top wall 56, an opposite bottom wall 58, a pair of opposite side walls 60 and a pair of opposite end walls 62 which are configured to form an elongated and enclosed plenum 64 (FIG. 3). The elongated plenum 64 has a first plenum portion 66*a* which is positioned generally in registry with the lamp face 32 and a second plenum portion 66*b* which is positioned outwardly of the lamp face 32 and in fluid communication with the first plenum portion 66*a*.

The exhaust system 12 is mounted to the lamp head 28 through a plurality of mounting screws 68 (FIG. 3) which extend upwardly through respective standoffs 70 (FIG. 3). The mounting screws 68 extend through apertures 72 (FIG. 2) formed in mounting flanges 74 (FIG. 2) of the exhaust duct 12 and are threadably engaged with aligned apertures 76 (FIG. 3) formed in mounting flanges 78 of the lamp head 28. As shown in FIG. 3, a gasket 80 is positioned between the mounting flanges 74 of the exhaust duct 12 and the mounting flanges 78 of the lamp head 28 to provide a generally air tight seal therebetween.

As shown in FIGS. 2 and 3, the bottom wall 58 of the exhaust duct 12 has an opening 82 formed therethrough which is positioned generally in registry with the microwave chamber 16. A lens 84, such as a quartz lens, is mounted to the bottom wall 58 of the exhaust duct 12 and is positioned generally in registry with the opening 82. A pair of elongated and generally "Z-shaped" mounting flanges 86 are mounted to the bottom wall 58 through screws 88 (FIG. 3) and have flange portions 90 which extend over opposite sides of the lens 84 to secure the lens 84 to the bottom wall 58. The lens 84 transmits the ultraviolet light 34 emitted through the lamp face 32 toward the substrate (not shown). A gasket 92 (FIG. 3) is positioned between a lower surface of the lens 84 and the bottom wall 58 about the opening 82 to provide a generally air tight seal therebetween. The quartz lens 84 is beneficial to reduce heat transfer to the substrate (not shown) from the plasma lamp bulb 22 and also serves as an air shield to prevent the cooling air 30 emitted from the lamp face 32 from contacting the substrate (not shown).

Figure 1:
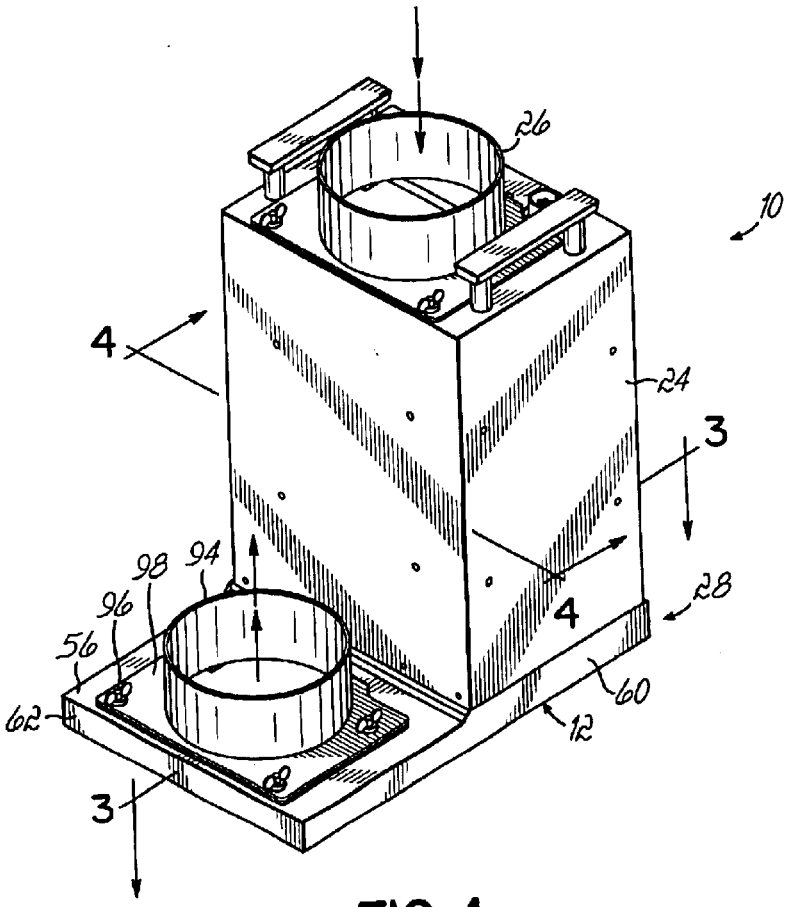
FIG. 1 is a perspective view of a microwave excited ultraviolet lamp system including an exhaust system mounted thereto in accordance with the principles of the present invention.

As shown in FIGS. 1–3, an air exhaust duct 94 is mounted to the top wall 56 of the exhaust duct 50 in generally registry with the air exhaust port 54. Wing nuts 96 extend through a mounting flange 98 of the air exhaust duct 94 and are engaged in aligned retainers 100 (FIG. 3). A gasket 102 is positioned between the mounting flange 98 of the air exhaust duct 94 and the top wall 56 of the exhaust duct 12 to provide a generally air tight seal therebetween. Of course, it will be appreciated that the configuration and orientation of the air exhaust port 54 and the air exhaust duct 94 can be changed without departing from the spirit and scope of the present invention. The air exhaust duct 94 is fluidly connected to an air exhaust system (not shown) so that the cooling air 30 is contained and directed within the exhaust 12 to an area where it will not contact and thereby possibly contaminate or disturb the substrate (not shown).

It is important that a sufficient cooling air flow rate, such as 350 CFM of cooling air for example, be provided within the housing 28 to insure proper operation of the magnetrons 14 and the plasma lamp bulb 22. To insure that a sufficient cooling air flow rate is being provided during operation of the light source 10, a differential pressure transducer 104 (FIG. 3) is mounted in fluid communication with the lamp head 28 and the exhaust duct 50. The pressure transducer 104 senses the pressure drop between the lamp head 28 and the air duct 50 and provides a signal to a control (not shown) of the light source 10 to shutdown operation when the desired pressure drop is not sensed by the pressure transducer 104.

Figure 6:
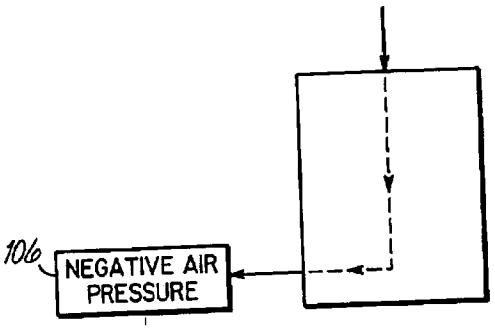

While light source 10 has been described in combination with a source of pressurized air 25 as shown in FIG. 1 and as shown diagrammatically in FIG. 6, it is contemplated in an alternative embodiment that a negative pressure source 106 (FIG. 6) may be used instead of the positive air pressure source 25 to draw cooling air 30 through the lamp head 28 and the exhaust system 12 as shown in FIG. 6.

Figure 7:
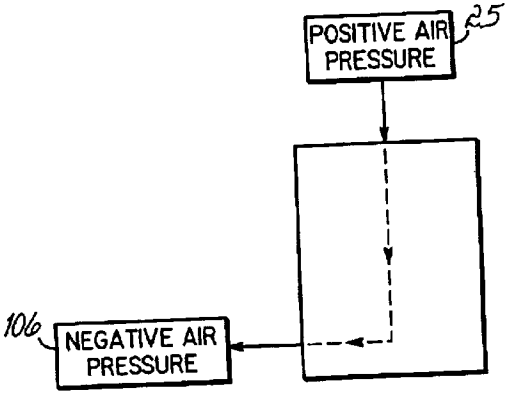
Figure 8:
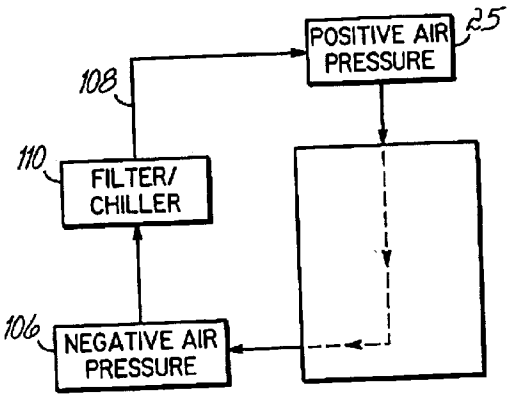

Alternatively, it is contemplated that a combination of a pressurized air source 25 connected to the air inlet duct 26 and a negative air pressure source 106 connected to the air exhaust duct 94, as shown diagrammatically in FIG. 7, may provide the necessary air flow rate through the light source 10. As shown diagrammatically in FIG. 8, it is also contemplated that an air recirculation path 108 may be provided to fluidly connect the negative air pressure source 106 to the positive air pressure source 25. In this embodiment, a filter and chiller 110 is provided in the recirculation path 108 to filter and cool the exhausted air from the exhaust duct 12 before it is recirculated to the positive air pressure source 25.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, we claim:

1. An exhaust system for use in a microwave excited ultraviolet lamp system having a lamp head terminating in a lamp face through which ultraviolet light and cooling air are emitted during ultraviolet irradiation of a substrate, the exhaust system comprising:

an enclosed exhaust duct capable of being supported in fluid communication with the lamp face and having an air inlet port configured to receive the cooling air emitted through the lamp face and an air exhaust port configured to direct the cooling air within said exhaust duct so as not to contact the substrate; and a lens supported by said exhaust duct and configured to transmit the ultraviolet light emitted through the lamp face toward the substrate.

2. The exhaust system of claim 1 wherein said exhaust duct comprises an elongated plenum having a first plenum portion configured to be positioned in general registry with the lamp face and a second plenum portion configured to be positioned outwardly of the lamp face.

3. The exhaust system of claim 2 wherein said air exhaust port is supported in fluid communication with said second plenum portion.

4. The exhaust system of claim 2 wherein said exhaust duct has a top wall, a bottom wall, a pair of side walls and a pair of end walls which are configured to define said elongated plenum.

5. The exhaust system of claim 4 wherein said bottom wall includes an opening therethrough and further wherein said lens is positioned in general registry with said opening.

6. The exhaust system of claim 1 wherein said lens comprises a quartz lens.

7. A microwave excited ultraviolet lamp system, comprising:

a lamp head terminating in a lamp face through which ultraviolet light and cooling air are emitted during ultraviolet irradiation of a substrate by said lamp head;

an enclosed exhaust duct supported by said lamp head in fluid communication with said lamp face and having an air inlet port which receives the cooling air emitted through said lamp face and an air exhaust port which directs the cooling air within said exhaust duct so as not to contact the substrate; and a lens supported by said exhaust duct which transmits the ultraviolet light emitted through said lamp face toward the substrate.

8. The microwave excited ultraviolet lamp system of claim 7 wherein said exhaust duct comprises an elongated plenum having a first plenum portion positioned in general registry with said lamp face and a second plenum portion positioned outwardly of said lamp face.

9. The microwave excited ultraviolet lamp system of claim 8 wherein said air exhaust port is supported in fluid communication with said second plenum portion.

10. The microwave excited ultraviolet lamp system of claim 8 wherein said exhaust duct has a top wall, a bottom wall, a pair of side walls and a pair of end walls which are configured to define said elongated plenum.

11. The microwave excited ultraviolet lamp system of claim 10 wherein said bottom wall includes an opening therethrough and further wherein said lens is positioned in general registry with said opening.

12. The microwave excited ultraviolet lamp system of claim 7 wherein said lens comprises a quartz lens.

13. The microwave excited ultraviolet lamp system of claim 7 further comprising a pressure sensor mounted in fluid communication with said lamp head and said exhaust duct.

14. The microwave excited ultraviolet lamp system of claim 13 wherein said pressure sensor comprises a differential pressure transducer.

15. A method of cooling a microwave excited ultraviolet lamp system having a lamp head configured to emit ultraviolet light through a lamp face thereof, comprising:

emitting ultraviolet light through the lamp face to irradiate a substrate;

directing cooling air through the lamp head;

emitting the cooling air through the lamp face;

containing the cooling air proximate the lamp face; and exhausting the cooling air at a location remote from the lamp head so that the cooling air does not contact the substrate.

* * * * *